US007893416B2

(12) United States Patent
Dror

(10) Patent No.: US 7,893,416 B2
(45) Date of Patent: Feb. 22, 2011

(54) DETECTING PRINTING PLATE EDGE ALIGNMENT

(75) Inventor: Yossef Dror, Ramat Gan (IL)

(73) Assignee: Eastman Kodak Company, Rochester, NY (US)

( * ) Notice: Subject to any disclaimer, the term of this patent is extended or adjusted under 35 U.S.C. 154(b) by 205 days.

(21) Appl. No.: 12/212,068

(22) Filed: Sep. 17, 2008

(65) Prior Publication Data

US 2010/0065762 A1 Mar. 18, 2010

(51) Int. Cl.
*G01N 21/86* (2006.01)

(52) U.S. Cl. ..... 250/559.36; 347/262

(58) Field of Classification Search ..... 250/559.29–559.38; 347/262
See application file for complete search history.

(56) References Cited

U.S. PATENT DOCUMENTS 5,739,913 A 4/1998 Wallace
5,859,440 A 1/1999 Acquaviva
6,611,345 B1 8/2003 Luxem
6,815,702 B2 * 11/2004 Kiermeier et al. ..... 250/559.36
7,115,889 B2 10/2006 Koker et al.

OTHER PUBLICATIONS

U.S. Appl. No. 12/045,058, filed Mar. 10, 2008, titled "Plate Pallet Alignment System", by Korolik et al.

* cited by examiner

*Primary Examiner*—Seung C Sohn
(74) *Attorney, Agent, or Firm*—J. Lanny Tucker; Nelson Adrian Blish

(57) ABSTRACT

A system for detecting the alignment of a top plate placed on a plate pallet. The alignment is detected relative to predetermined coordinates of the system. The system will generally include the following components: An illumination source configured to illuminate light on at least one edge of the top plate; a scanner for acquiring scanning results of the top plate edges. The scanning result will be analyzed by an analyzing component, in order to align the top plate correctly before it is loaded into the CTP imaging device.

16 Claims, 6 Drawing Sheets

DETECTING PRINTING PLATE EDGE ALIGNMENT

CROSS REFERENCE TO RELATED APPLICATIONS

Reference is made to commonly-assigned copending U.S. patent application Ser. No. 12/045,058, filed Mar. 10, 2008, entitled PLATE PALLET ALIGNMENT SYSTEM, by Korolik et al., the disclosure of which is incorporated herein.

TECHNICAL FIELD

The present invention relates generally to computer to plate (CTP) imaging devices, and more particularly to detecting the alignment of a top most plate in a plate picker system within a CTP imaging device.

BACKGROUND OF THE INVENTION

Prior to setting forth the background of the invention in detail, it may be helpful to set forth definitions of certain terms that will be used hereinafter.

The term "Computer to plate" (hereinafter: CTP) as used herein in this application, relates to an imaging technology used in modern printing processes. In this technology, an image created in a Desktop Publishing application is output directly to a printing plate. CTP as used hereinafter relates also to the imaging device carrying the process of outputting the computer-stored image on the printing plates.

The term "Printing Plates" (sometimes referred to as "plate" or "plates") as used herein in this application, relates to the flexible aluminum or plastic plates that are used in off-set printing technology. Traditional printing plates have a brushed or roughened texture and are covered with a photosensitive emulsion. A photographic negative of the desired image is placed in contact with the emulsion and the plate is exposed to light. After development, the emulsion shows a reverse of the negative image, which is thus a duplicate of the original (positive) image. The image on the plate emulsion can also be created through direct laser imaging in a CTP imaging device. Printing plates are typically stacked in a cassette, on a pallet or similar container which houses the plates and facilitates their protection, transportation, and handling, before loading them into a dedicated tray within a CTP imaging device.

Every CTP imaging device usually comprises trays for accommodating the printing plates exhibiting specific dimensions. Trays can usually be arranged to contain plates of various sizes, but all plates in the same tray are of one size. The plates may be manually removed from the cassette, pallet or a shipping container and then inserted into the trays for use by the CTP imaging device.

After the plates are loaded into a CTP imaging device tray and prior to the plate loading, the slip sheet is removed from the loaded plate. According to the traditional art, the slip sheet is removed from the CTP device using a slip sheet disposal system.

As the top plate positioned on the plate stack is often not positioned perfectly relatively to the plate stack, an alignment process has to be performed in order to position the top plate so that it is properly aligned for the plate picker operation.

According to the traditional art, a system for handling printing plates will generally use trays or plate pallet, the plates having specific dimensions. Different trays can usually be set to contain plates of various sizes, but all plates in a single tray will be in the same size. The plates can be picked automatically from the relevant trays or directly from the originally packed plate pallet and loaded into the imaging device for imaging. There is a widely recognized need for an automatic and efficient handling system for feeding plates directly from the original plate pallet into the imaging device, while maintaining precise alignment of the plate during the plate loading process.

FIG. 1 describes a pallet alignment and picker apparatus 10 according to the prior art. The top plate 13 is positioned on top of a plate pallet 14 (or a plate stack). Top plate 13 is often shifted slightly in respect to the plate pallet due to manual handling of the plate stack or pallet.

This manual process introduces inherent position inaccuracies in picking the top plate, in respect to the plate picker 11. Plate picker 11 is configured to pick a top plate 13 and load it into a CTP imaging device 20 (Shown in FIG. 2). The top plate 13 should be perfectly aligned with the plate picker position 12 in order to load plate 13 in a perfect position into the imaging device 20.

BRIEF SUMMARY

Briefly, according to one aspect of the present invention, there is provided a system for detecting misalignment of a top printing plate placed over a plate pallet, the plate exhibiting plate edges, wherein the alignment is detected in view of predetermined coordinates, the system comprising: an illumination source arranged to direct a light beam on at least one particular plate edge of the plurality of plate edges in a predefined spatial angle selected such that the light beam exhibits a spot of light covering a portion of the top plate, the particular edge and a portion of the plate pallet; a scanner arranged to scan the spot of light and produce an image thereof, and an analyzer arranged to detect the misalignment of the top printing plate by analyzing the differences between the properties of the image of the scanned spot of light and predefined properties pertaining to a spot of light covering a plate edge of a properly aligned top printing plate.

According to another aspect of the invention, there is provided a method of detecting misalignment of a top printing plate placed over a plate pallet, the plate exhibiting plate edges, wherein the alignment is detected in view of predetermined coordinates, the method comprising: directing a light beam on at least one particular plate edge of the plurality of plate edges in a predefined spatial angle selected such that the light beam exhibits a spot of light covering a portion of the top plate, the particular edge and a portion of the plate pallet; scanning the spot of light and producing an image thereof; detecting the misalignment of the top printing plate by analyzing the differences between the properties of the image of the scanned spot of light and predefined properties pertaining to a spot of light covering a plate edge of a properly aligned top printing plate.

According to another aspect of the invention, there is provided a computer-to-plate (CTP) imaging device comprising a system for detecting misalignment of a top printing plate placed over a plate pallet operatively associated with the CTP imaging device, the plate exhibiting plate edges, wherein the alignment is detected in view of predetermined coordinates, the system comprising: an illumination source arranged to direct a light beam on at least one particular plate edge of the plurality of plate edges in a predefined spatial angle selected such that the light beam exhibits a spot of light covering a portion of the top plate, the particular edge and a portion of the plate pallet; a scanner arranged to scan the spot of light and produce an image thereof, and an analyzer arranged to detect the misalignment of the top printing plate by analyzing the differences between the properties of the image of the scanned spot of light and predefined properties pertaining to a spot of light covering a plate edge of a properly aligned top printing plate.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

The subject matter regarded as the invention will become more clearly understood in light of the ensuing description of embodiments herein, given by way of example and for purposes of illustrative discussion of the present invention only, with reference to the accompanying drawings (Figures, or simply "FIG."), wherein.

The drawings together with the description make apparent to those skilled in the art how the invention may be embodied in practice.

DETAILED DESCRIPTION OF THE INVENTION

In the following detailed description, numerous specific details are set forth in order to provide a thorough understanding of the disclosure. However, it will be understood by those skilled in the art that the teachings of the present disclosure may be practiced without these specific details. In other instances, well-known methods, procedures, components and circuits have not been described in detail so as not to obscure the teachings of the present disclosure.

The present invention includes an apparatus, system and a method for correctly position a printing plate to be imaged. The correct positioning of the printing plate is made in respect to the plate loading mechanism of a CTP imaging device. The printing plate to be imaged is usually a top plate picked up from a stack of printing plates.

According to some embodiments there is provided a system for detecting misalignment of a top printing plate placed over a plate pallet, the plate exhibiting plate edges, wherein the alignment is detected in view of predetermined coordinates. The system comprising: an illumination source arranged to direct a light beam on at least one particular plate edge of the plurality of plate edges in a predefined spatial angle selected such that the light beam exhibits a spot of light covering a portion of the top plate, the particular edge and a portion of the plate pallet; a scanner arranged to scan the spot of light and produce an image thereof; and an analyzer 404 (shown in FIG. 4) arranged to detect the misalignment of the top printing plate by analyzing the differences between the properties of the image of the scanned spot of light and predefined properties pertaining to a spot of light covering a plate edge of a properly aligned top printing plate.

Figure 1:
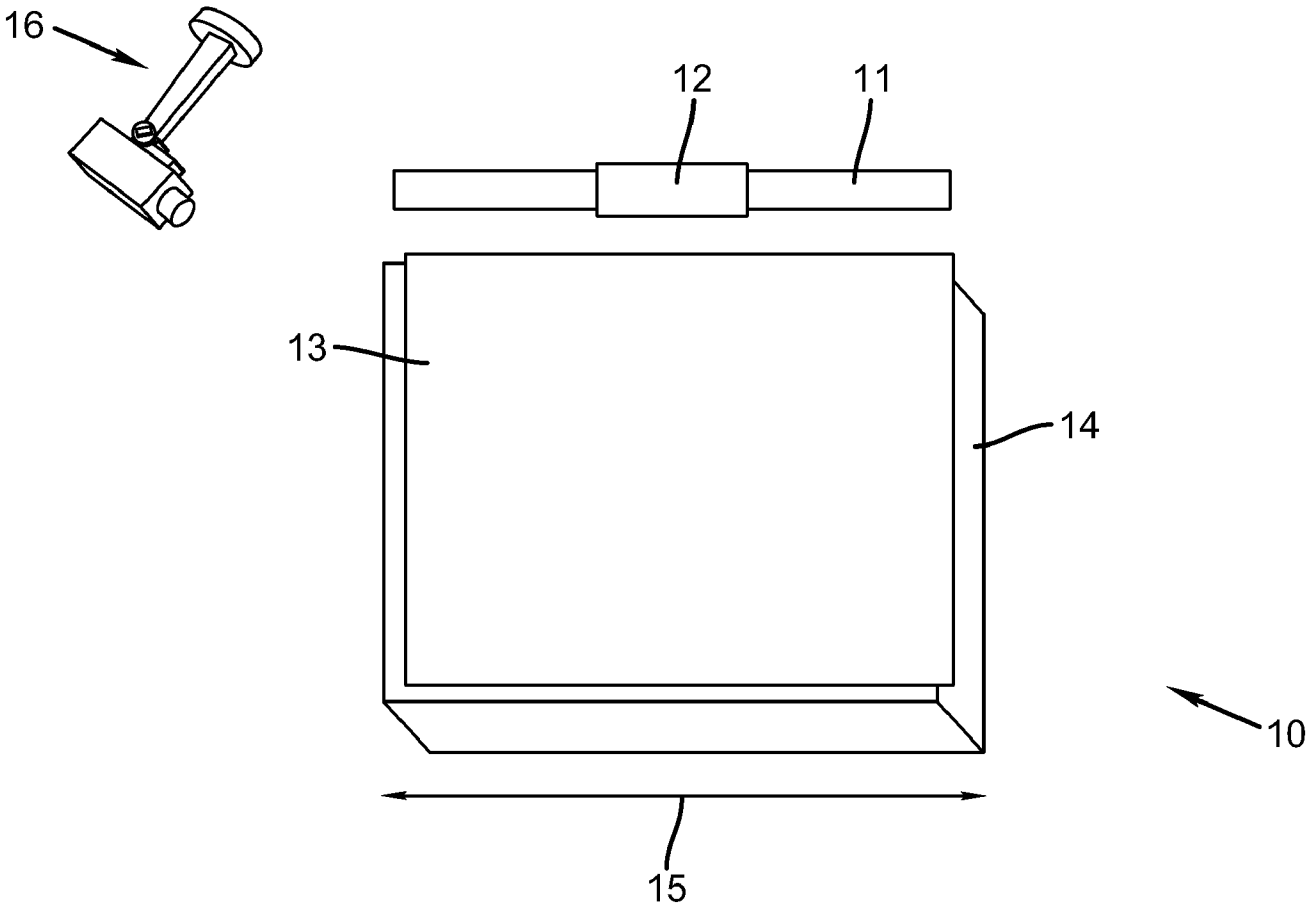
FIG. 1 (PRIOR ART)
FIG. 1 is a schematic illustration of a plate pallet exhibiting a plate picker according to the prior art.
Figure 2:
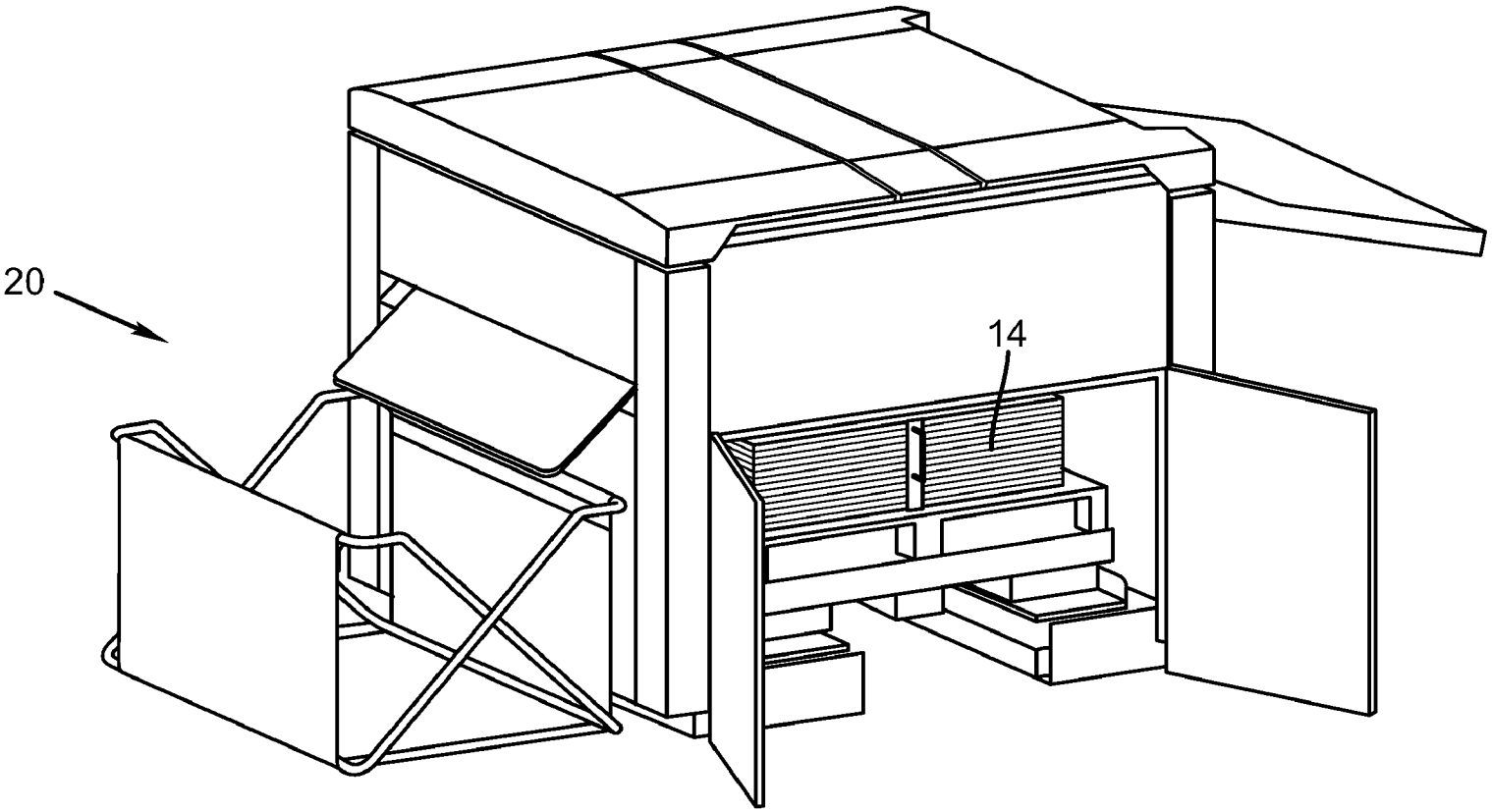
FIG. 2 (PRIOR ART)
FIG. 2 is a perspective view of a computer-to-plate imaging device showing a plate pallet according to the prior art.

Referring to FIG. 1-2, top perfect positioning of plate 13 in respect to plate picker position 12 is performed by moving the entire plate pallet 14 in the pallet positioning path 15.

According to the present invention, the required movement direction and amount is derived from the exact position of top plate 13. The exact position of top plate 13 is calculated from the following parameters: plate size—a known parameter per plate type; chassis position 32 (FIG. 3A)—fixed position—a known parameter per CTP imaging device; and plate edge detection. This parameter is the product of the disclosed invention hereunder.

The edge of top plate 13 is detected by processing an image of the plate edge captured by camera 16. The captured image with the lighting conditions inside the CTP imaging device 20 will not produce adequate information for processing the edge of top plate 13.

The disclosed invention includes applying specific illumination means on top plate 13 and plate pallet 14 prior to capturing an image with camera 16. The applied illumination will help in finding out the exact plate edge.

Figure 3A:
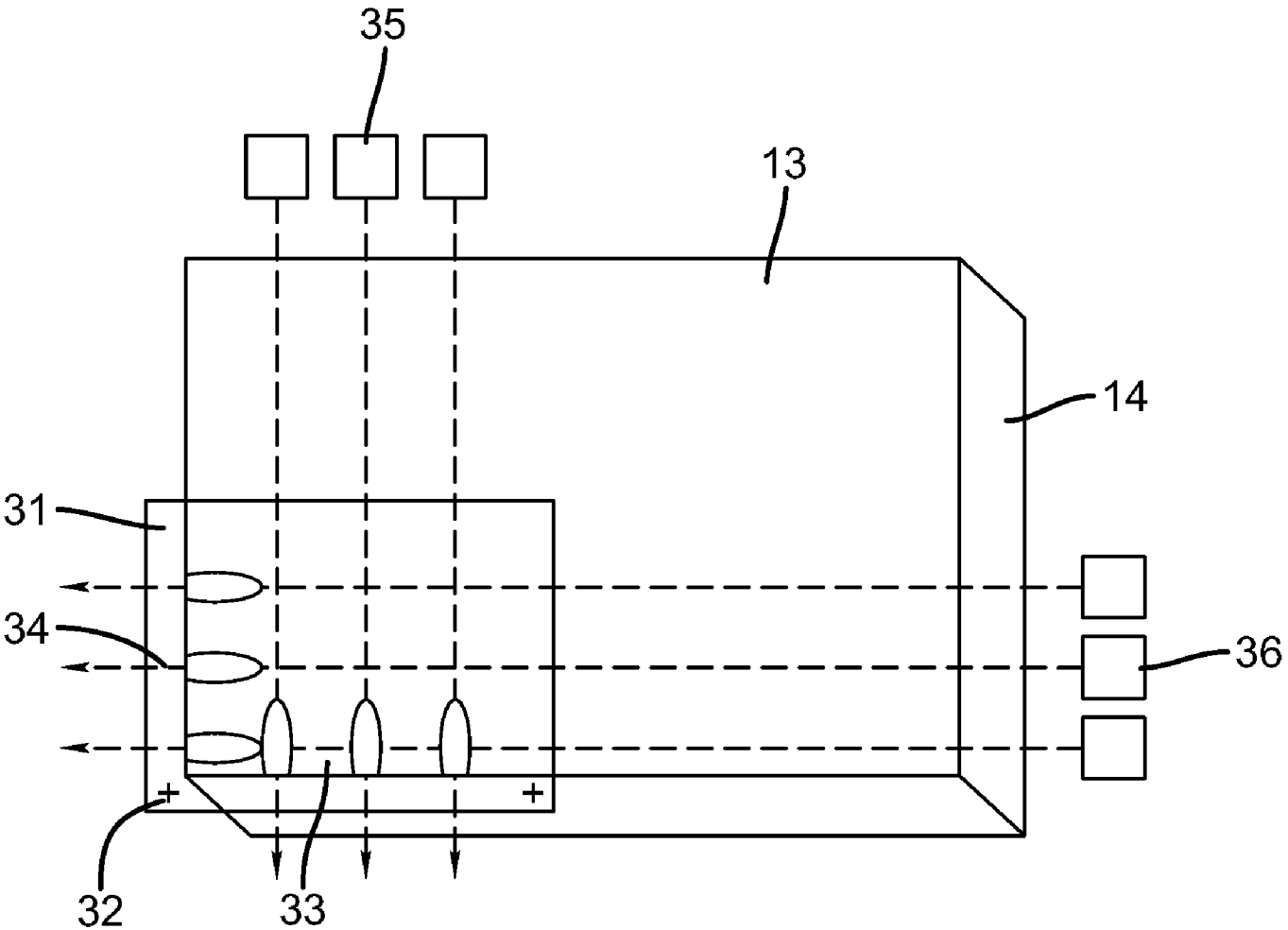
FIG. 3A is a schematic illustration of a top plate aligned with plate pallet according to some embodiments of the present invention.
Figure 3B:
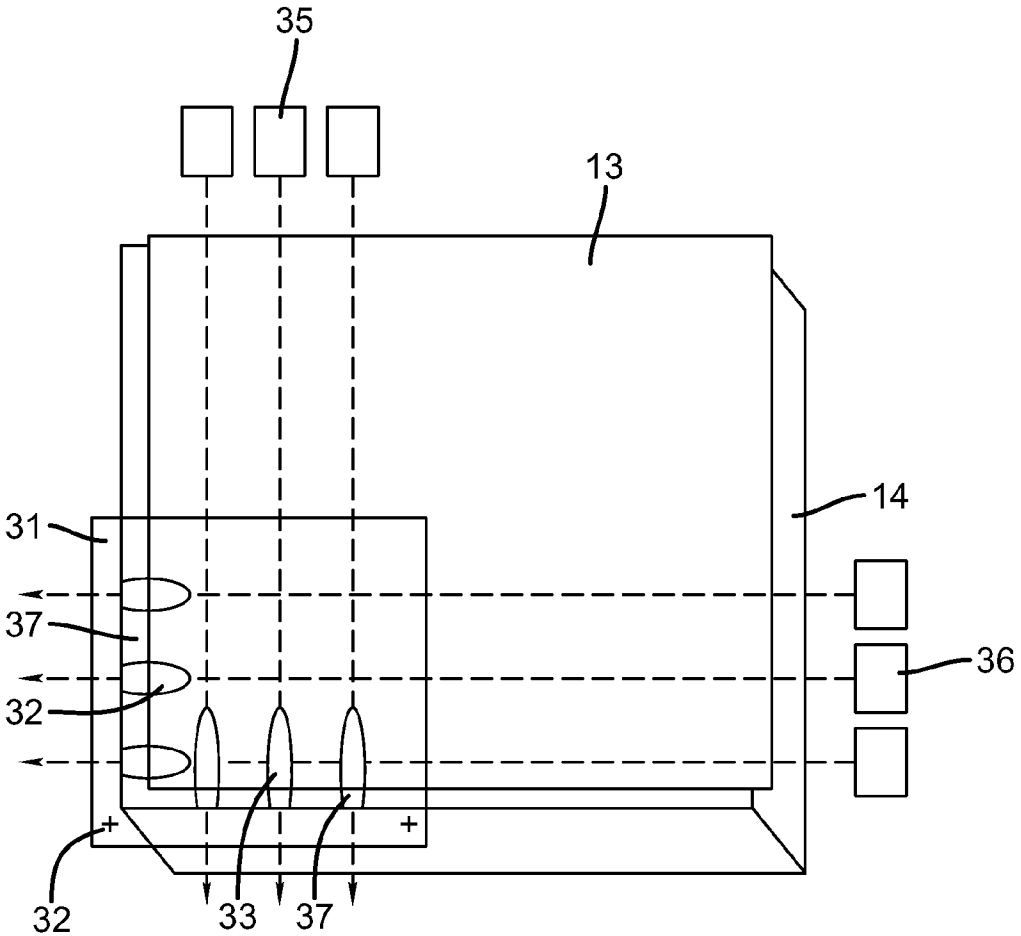
FIG. 3B is a schematic illustration of a top plate shifted in respect to plate pallet.
Figure 3C:
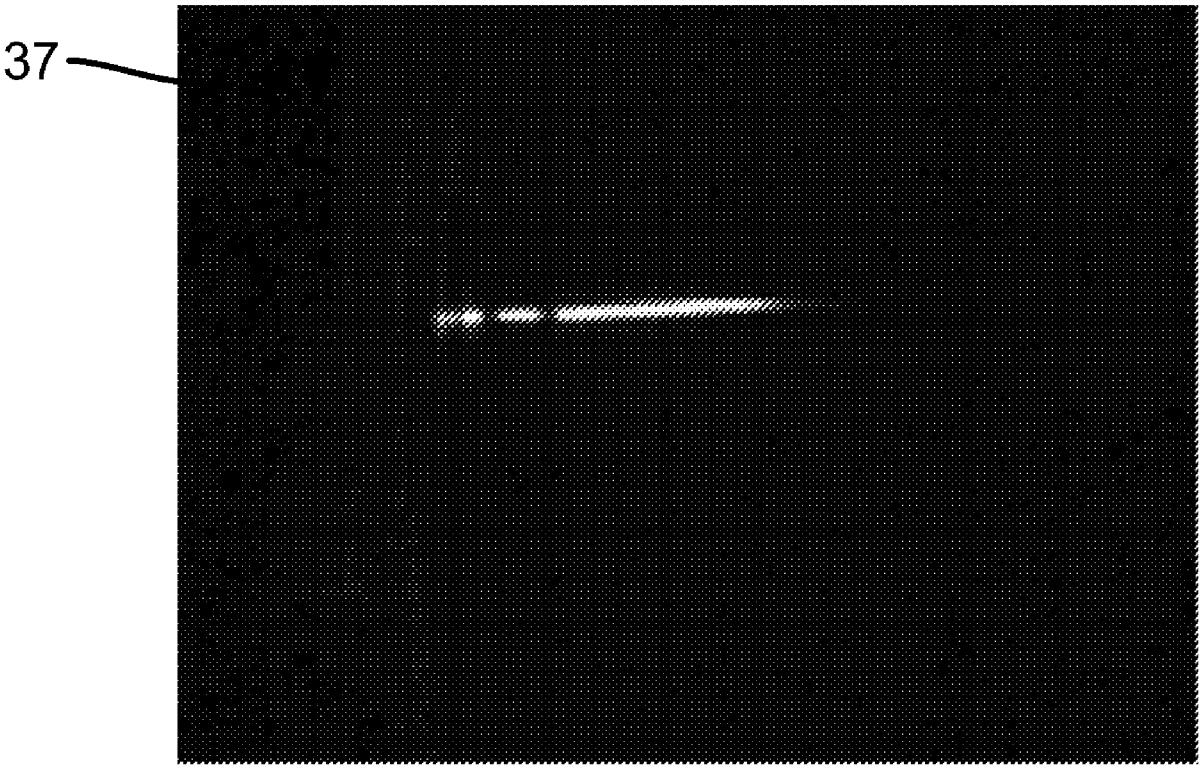
FIG. 3C is a schematic illustration of a shadow created due to top plate shift according to some embodiments of the present invention.

The illumination is performed with a plurality of laser pointers. FIG. 3A and FIG. 3B shows pointers 35 positioned against the vertical axis and pointers 36 positioned against the horizontal axis of top plate 13. Camera 16 is configured to capture a dedicated camera window 31 above the edge of top plate 13. The captured camera window 31 is analyzed to inspect the shapes created by vertical beams 33 and horizontal beams 34. The beams are created by pointers 35 and 36 respectively. In the case where top plate 13 is not perfectly aligned on plate pallet 14 a shadow line 37 will be detected as is shown FIG. 3B. FIG. 3C shows an example of shadow line 37 captured by camera 16. The start shadow line 37 will indicate the edge of the plate in this case.

In the case where the top plate 13 is perfectly aligned to pallet 14 or top plate 13 is extending over plate pallet 14 the result of the illumination will not create a shadow. In this case the end of the created beams 33, 34 will indicate the edge of plate 13.

The detected plate edge together with the fixed chassis position 32 will indicate the correct amount and direction that the plate pallet 14 position should be adjusted to perfectly align with plate picker position 12. The repositioning of plate pallet 14 enables perfect loading of plate 13 into the CTP imaging device 20.

Figure 4:
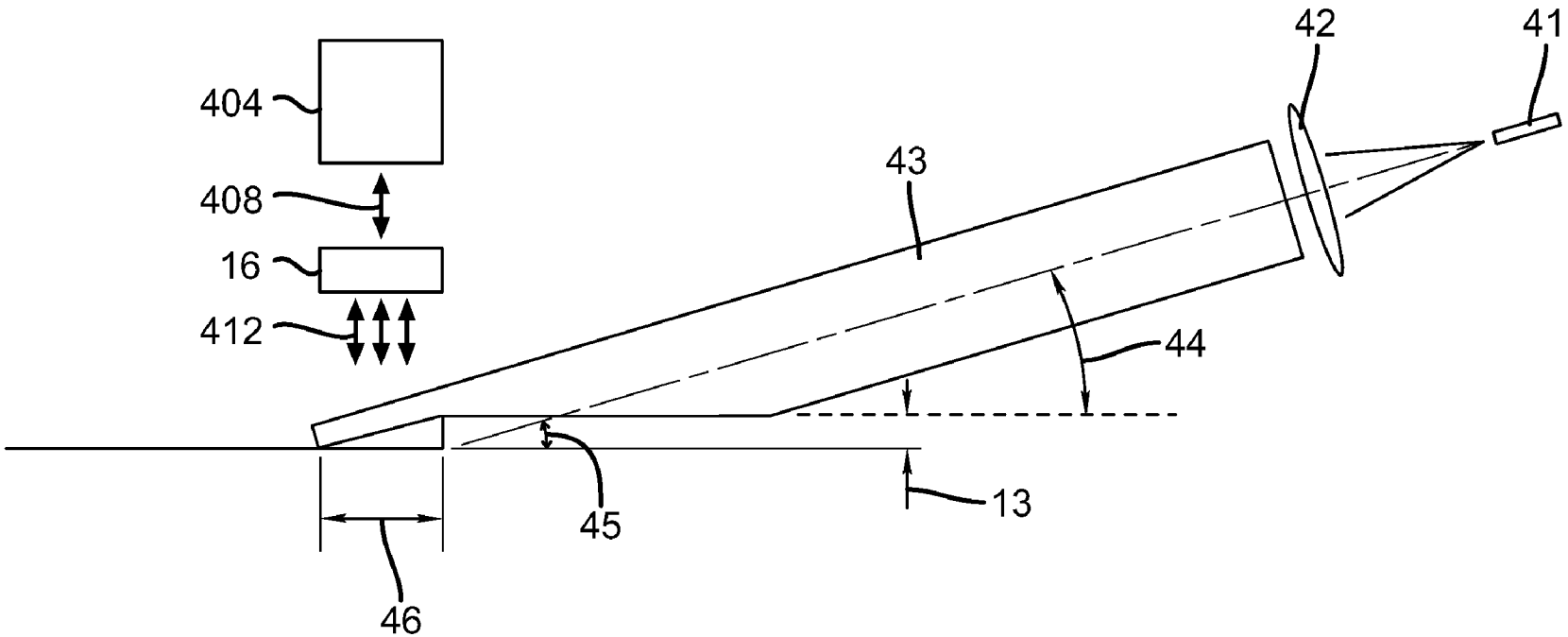
FIG. 4 is a schematic of a laser pointers system showing a top micro view of the plate pallet according to some embodiments of the present invention.

FIG. 4 describes the optical system disclosed in this invention. Laser source 41 is positioned above the plate pallet 14. Laser source 41 illuminates a light beam 43 through lens 42. Beam 43 is directed towards the edge of top plate 13 at a laser projection angle 44 (a typical angle is around 8 degrees and may range between 5 to 15 degrees approximately). A shadow is formed between the top plate 13 and the plates underneath it. The created shadow range 46 is dependent upon plate thickness 45, laser projection angle 44 and top plate 13 shift amount in respect to plate pallet 14.

The size of the created shadow is captured by camera 16 via capture data 412. The alignment of plate 13 will be calculated by analyzer 404, by analyzing the data received from camera 16 via communication lines 408, according to the size of the captured shadow by camera 16 and will applied on top plate 13 before loading it into device 20.

According to some embodiments of the invention, the disclosed system may be further arranged to convert a particular image of the scanned spot of light to a corresponding signature, and wherein the detection of top printing plate misalignment is achieved by comparing the signature of the particular image of the scanned spot of light to predetermined plurality of signatures, each of the plurality of the predetermined plurality of signatures is associated with a specific printing plate misalignment exhibiting specific coordinates.

According to some embodiments of the invention, the scanned spot of light exhibits variations in the intensity of light in accordance with the misalignment of the top printing plate, and wherein the analyzer is further arranged to detect the misalignment of the top printing plate in view of the variations of the intensity of light in the scanned spot of light.

According to some embodiments of the invention, the scanned spot of light exhibits a shadow line wherein the location of the shadow line is associated with the misalignment of the top printing plate and wherein the analyzer is further arranged to detect the location of the particular edge of the top printing plate in view of the location of the shadow line.

The invention has been described in detail with particular reference to certain preferred embodiments thereof, but it will be understood that variations and modifications can be effected within the scope of the invention.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

PARTS LIST

10 pallet alignment and picker apparatus
11 plate picker
12 plate picker position
13 top plate
14 plate pallet
15 pallet positioning path
16 camera
20 CTP imaging device
31 camera window
32 chassis position
33 vertical beams
34 horizontal beams
35 vertical pointers
36 horizontal pointers
37 shadow
41 laser source
42 optics lens
43 beam
44 laser projection angle
45 plate thickness
46 shadow width
404 analyzer
408 communication line between camera and analyzer
412 camera data capture lines

The invention claimed is:

1. A system for detecting misalignment of a top printing plate placed over a plate pallet, the plate exhibiting plate edges, wherein the alignment is detected in view of predetermined coordinates, the system comprising:

an illumination source arranged to direct a line profile light beam on at least one particular plate edge of the plurality of plate edges in a predefined low spatial angle selected such that the light beam exhibits a spot of light covering a portion of the top plate, the particular edge and a portion of the plate pallet;

a scanner arranged to scan the spot of light and produce an image thereof; and an analyzer arranged to detect the misalignment of the top printing plate by analyzing the differences between the properties of the image of the scanned spot of light and predefined properties pertaining to a spot of light covering a plate edge of a properly aligned top printing plate.

2. The system according to claim 1, wherein said scanned spot of light exhibits variations in the intensity of light in accordance with the misalignment of the top printing plate, and wherein said analyzer is further arranged to detect the misalignment of the top printing plate in view of the variations of the intensity of light in said scanned spot of light.

3. The system according to claim 1, wherein said scanned spot of light exhibits a shadow line wherein the location of the shadow line is associated with the misalignment of the top printing plate and wherein said analyzer is further arranged to detect the location of the particular edge of the top printing plate in view of the location of the shadow line.

4. The system according to claim 1, wherein said illumination source comprises a laser source.

5. The system according to claim 4, wherein said laser source comprises at least one laser pointer.

6. The system according to claim 1, wherein the spatial angle between the beam of light and the top printing plate ranges between approximately 5 degrees and 15 degrees.

7. The system according to claim 1, wherein said scanner comprises a digital camera.

8. A method of detecting misalignment of a top printing plate placed over a plate pallet, the plate exhibiting plate edges, wherein the alignment is detected in view of predetermined coordinates, the method comprising:

directing a light beam on at least one particular plate edge of the plurality of plate edges in a predefined low spatial angle selected such that the light beam exhibits a spot of light covering a portion of the top plate, the particular edge and a portion of the plate pallet wherein the line profile light beam forms at least one spot light and at least one shadow area along the path of the light beam;

scanning the spot of light and producing an image thereof;

detecting the misalignment of the top printing plate by analyzing the differences between the properties of the image of the scanned spot of light and predefined properties pertaining to a spot of light covering a plate edge of a properly aligned top printing plate.

9. The method according to claim 8, wherein the scanned spot of light exhibits variations in the intensity of light in accordance with the misalignment of the top printing plate, and wherein detecting the misalignment of the top printing plate is performed in view of the variations of the intensity of light in said scanned spot of light.

10. The method according to claim 8, wherein said scanned spot of light exhibits a shadow line and wherein the location of the shadow line is associated with the misalignment of the top printing plate and wherein detecting the location of the particular edge of the top printing plate is performed in view of the location of the shadow line.

11. A computer-to-plate (CTP) imaging device comprising a system for detecting misalignment of a top printing plate placed over a plate pallet operatively associated with the CTP imaging device, the plate exhibiting plate edges, wherein the alignment is detected in view of predetermined coordinates, the system comprising:

an illumination source arranged to direct a light beam on at least one particular plate edge of the plurality of plate edges in a predefined spatial angle selected such that the light beam exhibits a spot of light covering a portion of the top plate, the particular edge and a portion of the plate pallet;

a scanner arranged to scan the spot of light and produce an image thereof; and an analyzer arranged to detect the misalignment of the top printing plate by analyzing the differences between the properties of the image of the scanned spot of light and predefined properties pertaining to a spot of light covering a plate edge of a properly aligned top printing plate.

12. The CTP imaging device according to claim 11, wherein said scanned spot of light exhibits variations in the intensity of light in accordance with the misalignment of the top printing plate, and wherein said analyzer is further arranged to detect the misalignment of the top printing plate in view of the variations of the intensity of light in said scanned spot of light.

13. The CTP imaging device according to claim 11, wherein said scanned spot of light exhibits a shadow line wherein the location of the shadow line is associated with the misalignment of the top printing plate and wherein said analyzer is further arranged to detect the location of the particular edge of the top printing plate in view of the location of the shadow line.

14. The CTP imaging device according to claim 11, wherein said illuminating source comprises at least one laser pointer.

15. The CTP imaging device according to claim 11, wherein the detected misalignment exhibits two dimensional coordinates.

16. The CTP imaging device according to claim 15, further comprising an alignment unit arranged to correct the detected misalignment by relocating the top printing plate in accordance with the detected two dimensional coordinates.

* * * * *